United States Patent [19]

Nagamoto

[11] Patent Number: 4,616,201

[45] Date of Patent: Oct. 7, 1986

[54] ELECTROMAGNETIC RELAY

[75] Inventor: Mitsuki Nagamoto, Tsu, Japan

[73] Assignee: Matsushita Electric Works, Ltd., Osaka, Japan

[21] Appl. No.: 672,222

[22] Filed: Nov. 16, 1984

[30] Foreign Application Priority Data

Nov. 30, 1983 [JP] Japan ..... 58-184929[U]

[51] Int. Cl.[4] ..... H01H 67/02

[52] U.S. Cl. ..... 335/129; 335/107; 335/128; 335/135

[58] Field of Search ..... 335/129, 135, 127, 128, 335/107, 199

[56] References Cited

U.S. PATENT DOCUMENTS

| | | | |
|---|---|---|---|
| 2,136,612 | 11/1938 | Dubuar | 335/129 |
| 3,800,250 | 3/1974 | Mori et al. | 335/135 |
| 3,911,383 | 9/1975 | Tabei et al. | 335/128 |

*Primary Examiner*—E. A. Goldberg
*Assistant Examiner*—Lincoln Donovan
*Attorney, Agent, or Firm*—Armstrong, Nikaido Marmelstein & Kubovcik

[57] ABSTRACT

An electromagnetic relay comprises an excitation coil for actuating relay contacts through the operation of a card coupled to an armature of the coil. The relay has at least one double-throw switch in which a pair of first and second movable contact members are driven to move with respect to a fixed or common contact member disposed therebetween for closing and opening contact operations in cooperation with the fixed contact. All these contact members are mounted on a contact base such that the fixed contact member is arranged between the first and second contact members. Also mounted on the contact base is at least one set of common, first, and second terminal lugs which are connected respectively to the fixed, first and second contact members to project downwardly from the base. The first and second terminal lugs are disposed in generally vertical alignment respectively with the corresponding first and second contact members, while the common terminal lug is disposed out of vertical alignment with the corresponding common contact member so as to be terminal arrangement of a conventional relay of flexure type having the like double-throw switch arrangement so that the above relay can be well compatible therewith.

9 Claims, 16 Drawing Figures

ELECTROMAGNETIC RELAY

BACKGROUND OF THE INVENTION

The present invention is directed to an electromagnetic relay, and more particularly to the construction of an electromagnetic relay of the type having at least one double-throw switch in which a pair of movable contacts are biased toward a fixed common contact and are driven in the direction of being released from the fixed common contact against the biasing forces thereof for closing and opening contact operations.

The relays of the above switch arrangement are frequently referred to as card relays of lift-off type in contrast to the conventional relays of so-called flexure type which has the same double-throw switch arrangement but has a different contact arrangement of forcibly moving or flexing a common contact disposed between a pair of fixed contacts and normally retained in spaced relation thereto into the contacting engagement therewith at the time of closing operation. Such relays of flexure type have been widely used to an extent that they may be regarded as a standard type relay in certain application field. In recent years, however, the above card relays of lift-off type have an increased chance to be utilized in place of the flexure-type relays of the like operating performance or like dimensions. The problem occurs when substituting the card relays of lift-off type for the relays of flexure type since they have different terminal arrangements and require different wiring or sockets, rendering such substitution very complicated and cumbersome. That is, as exemplarily shown in FIG. 1, the flexure relay 1 of general-purpose type has a universal terminal arrangement in which normally closed (NC) terminal lugs 2A, normally open (NO) terminal lugs 3A, and common (COM) terminal lugs 4A are disposed in this order due to its structural requirement of supporting common contacts 4 on an armature 6 which are spaced upwardly from pairs of NC and NO contacts 3 and 4 mounted on a base 5 of the relay and are connected to the corresponding COM terminal lugs 4A mounted on the base 5 in spaced relation with respect to the sets of the NC and NO contacts 3 and 4. While on the other hand, in the card relay of lift-off type having a fixed or common (COM) contact between a pair of complementary movable contacts serving as NC and NO contacts, all these contact are normally mounted on a base of the relay so as to naturally result in the corresponding terminal arrangement of disposing the NC, COM and NO terminal lugs in this order. In fact, this NC-COM-NO relation corresponding to the arranging order of the contacts is the simplest for mounting on the base the several contacts together with the several terminal lugs. But, this NC-COM-NO terminal arrangement will render such card relays not to be compatible with the above relays of flexure type having NC-NO-COM terminal arrangement in the sense of using common wiring operations or common sockets. Accordingly, the card relays of lift-off type are mostly desired to have the same terminal arrangement as the relays of flexure type for increased versatility.

SUMMARY OF THE INVENTION

The present invention has been devised in view of the above and provides an advantageous construction by which the above card relays of lift-off type can be designed to have the same terminal arrangement as that of widely used relays of flexure type without requiring substantial increase in complexity and space. The relay of the present invention includes an electromagnetic unit and a contact unit disposed in side-by-side relation with one another. Said electromagnetic unit includes an excitation coil and a coil base therefor. Included in the contact unit are at least one set of fixed, first, and second contact members which are supportedly mounted on a contact base such that the fixed contact member is disposed between the first and second contact members to define a double-throw switch in which the fixed contact member serves as a common (COM) contact, the first contact member as a normally-closed (NC) contact, and the second as a normally-open (NO) contact. That is, said movable NC and NO contacts are biased in the direction of contacting with the fixed common contact and are set in such a relationship that the NO contact is released from the COM contact against the biasing force by a card connecting the first and second contact members with an armature of the excitation coil. It is this card that in response to the armature movement drives the NC contact members as well as the NO contact members with respect to the fixed COM contact for opening and closing contact operations. Projecting downwardly from said contact base are at least one set of common, first, and second terminal lugs which are connected respectively to said COM, NC, and NO contact members so as to correspondingly form a set of COM, NC, and NO terminal lugs. The NC and NO terminal lugs are in generally vertical alignment respectively with the NC and NO contact members, while the COM terminal lug is spaced laterally from the COM contact member to be located on the opposite side of the NC terminal lug from the NO terminal lug such that the relay has a terminal arrangement in which the terminal lugs are disposed in NC-NO-COM relationship just as in the conventional relays of flexure type. The terminal lug serving as the COM terminal is connected to the COM contact member on the contact base through a transition segment which extends horizontally around the root portion of the adjacet NO terminal lug from the position just below the corresponding COM contact member to a laterally spaced position beyond the adjacent NO terminal lug in an insulating relationship therefrom. Such insulation is accomplished by forming on the root portion of the NO terminal lug an insulative sleeve by which the above transition segment can be insulatedly spaced from the adjacent NO terminal lug. With this arrangement, the COM terminal lug can be successfully shifted from the position between the NO and NC terminal lugs to a position on the opposite side of the NO terminal lug in such a manner as to require only the transition segment on the underside of the contact base and therefore require no other space-consuming and complicated member on the upper side of the contact base.

Accordingly, it is a primary object of the present invention to provide an electromagnetic relay of lift-off type which can be compatible with the conventional relays of flexure type having the NC-NO-COM terminal arrangement and which can be assembled without requiring a substantial increase in complexity and space.

In a preferred embodiment, said coil base is provided with at least one projection which projects toward the contact base carrying the above contact members and the terminal lugs in such a way as to extend into a corresponding hole formed in the contact base for interconnection therebetween. This enables an exact alignment between the electromagnetic unit and the contact unit so as to ensure an easy and position-correct assembly thereof in corporation with the employment of a clamp fastening together the coil and contact units.

It is therefore another object of the present invention to provide an electromagnetic relay of lift-off type which is easy to assemble yet has an increased positioning accuracy.

Said excitation coil is mounted on the coil base with its axis extending vertically or perpendicular to the general plane of the coil base so as to locate one of flanges on opposite ends thereof at an elevated position from the plane of the base. Included in said contact unit is a header of electrically insulative material through which the upper portions of plural fixed or COM contact members extend to be supported thereby in spaced relation with each other. The header is formed with an integral nose which extends beyond the adjacent NO contact members for abutment with the upper flange of the excitation coil, whereby the exact spacing between the upper portions of the coil and contact units can be obtained by better utilization of the header for supporting the COM contact members in spaced relation with each other. With this construction, the card bridging between the coil and contact units can be in exact alignment with respective NC and NO contact members for accurately actuating the same.

It is therefore a further object of the present invention to provide an electromagnetic relay which is capable of easily assembling the coil and contact units, yet assuring accurate closing and opening operations of the contacts.

Also disclosed in the present invention is an advantageous feature in which a pair of prongs extend from the header toward the upper end of a core of said excitation coil so that the upper end of the core is snugly received between the free end portions of the prongs. This prevents a possible misalignment between the coil and contact units in a plane normal to a direction of assembling the units to thereby further increase the positioning accuracy, which is a still further object of the present invention.

In another preferred embodiment, the header is formed with is defined by a plurality of teeth which extend from the header beyond NO contact members through the spacings between the adjacent ones thereof so as to be in engagement with complementary spaced recesses in the upper flange of the excitation coil. This is also effective in preventing the above misalignment between the coil and contact units in a plane normal to a direction of assembling the units.

These and other advantageous and useful features will be apparent from the following detailed description of the preferred embodiments when taken in conjunction with the accompanying drawings.

DETAILED DESCRIPTION OF THE PREFERRED EMBODIMENTS

Figure 8:
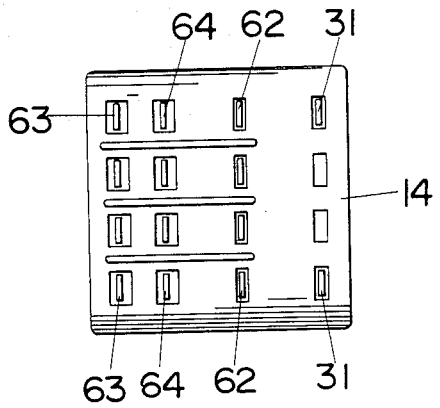
FIG. 8 is a bottom view of the above relay.
Figure 9:
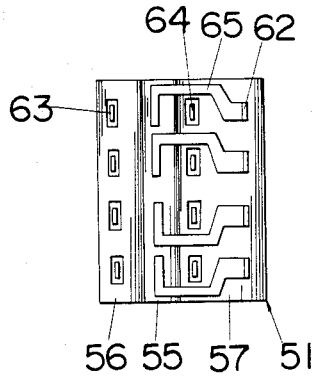
FIG. 9 is a bottom view of a contact unit employed in the above relay.
Figure 10:
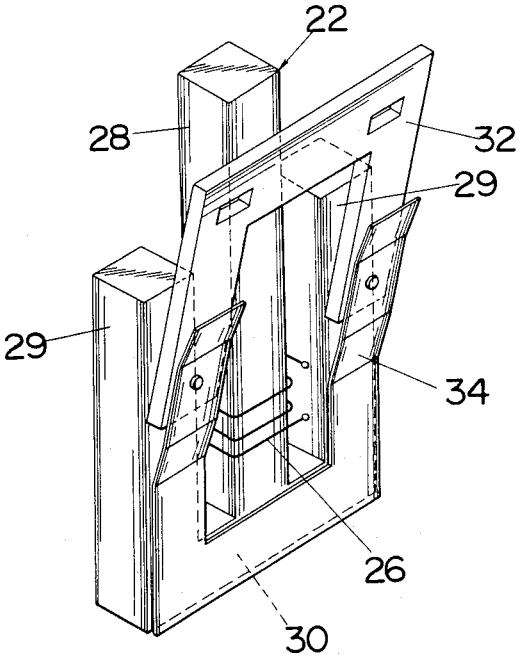
FIG. 10 is a perspective view schematically illustrating an excitation coil and an armature employed in the above relay.

Referring now to FIGS. 2 through 10, there is shown an electromagnetic relay of the kind frequently referred to as a card relay of lift-off type in accordance with a first preferred embodiment of the present invention. The relay is basically composed of an electromagnetic unit 20 and a contact unit 50 which are held together by a clamp 11 prior to being enclosed within a relay casing 12 composed of upper and lower halves 13 and 14. Included in the electromagnetic unit 20 is an excitation coil 21 which comprises a yoke 22, a coil bobbin 23 with flanges 24 and 25 on opposite ends thereof, and a winding 26. As best shown in FIG. 10, the yoke 22 is formed into a generally E-shaped configuration with an elongated center leg 28 serving as a core and shortened side legs 29 extending from a web 30. The yoke 22 is supported vertically on the lower flanges 25 with the web 30 secured thereto and with the center leg 28 extending upwardly through the coil bobbin 23 such that the axis of the center leg 28 is perpendicular to the general plane of the flange 25. Said lower flanges 25 is molded to have an increased thickness to define a coil base on which said excitation coil 21 is mounted. The coil 21 is electrically connected to a pair of coil terminal lugs 31 extending through said lower flange or coil base 25 for being energized by an external voltage source to be connected thereto.

Cooperative with the yoke 22 is an armature 32 of generally inverted U-shaped configuration which is placed upon one surface of the yoke 22 with the lower end edges 33 thereof being pivotally supported on the side legs 29 of the yoke 22 by means of a bearing spring 34, whereby the armature 32 is movable held on the yoke 22. A card 40 of plate-like electrically insulative member is connected at its rear bifurcated ends to the armature 32 for movement therewith between a set position and a reset position in response to said excitation coil 21 being energized and deenergized. The card 40 is for actuating a number of switches on said contact unit 50 and is therefore connected at its front end to the switches, the details of which will be described later.

Said contact unit 50 comprises a contact base 51 of electrically insulative plastic material on which are mounted a row of four fixed or common contact members 52, a row of four first contact members 53 serving as normally-closed (NC) contacts, and a row of four second contact members 54 as normally-open (NO) contacts, these rows are arranged in respective planes parallel with each other as disposing each of the contact members in parallel relationship with the axis of the yoke 22 or the excitation coil 21. Said contact base 51 is composed of three three separate bases 55, 56, and 57 which mount thereon respectively said fixed, first, and second contact members and which are assembled together such as by an suitable adhesive and by welding. The base 57 of the second contact members 54 is formed therein with a pair of horizontal holes 58 which receives respectively projections 35 integrally projecting from said coil base 25 for effecting an easy and accurate positioning at the time of assembling the electromagnetic unit 20 and the contact unit 50.

Figure 1:
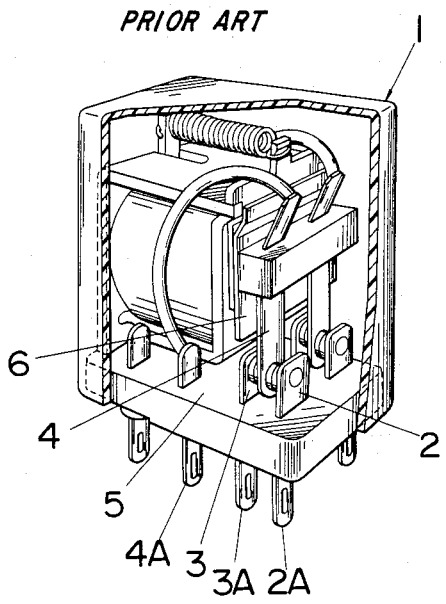
Fig. 1 PRIOR ART
FIG. 1 is a perspective view of a conventional relay of flexure type.
Figure 2:
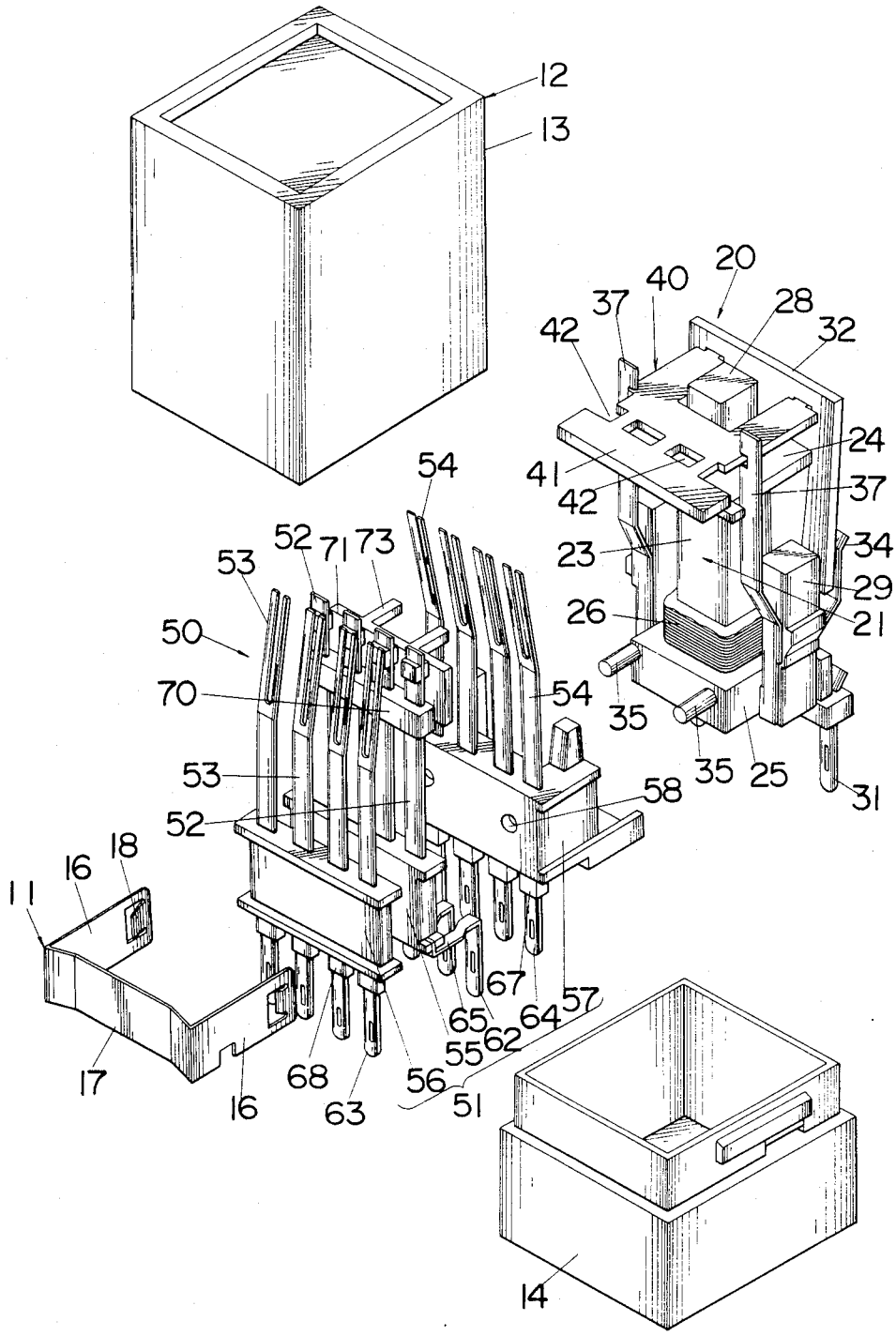
FIG. 2 is an exploded perspective view of a card relay of lift-off type in accordance with a first preferred embodiment of the present invention.
Figure 3:
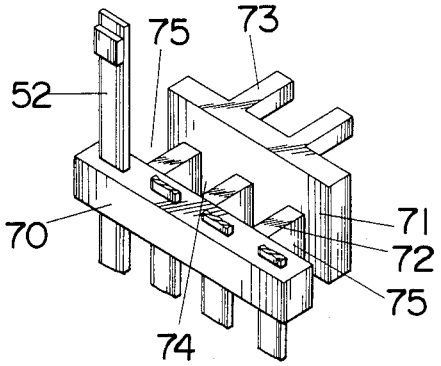
FIG. 3 is a perspective view showing a header and its associated parts employed in the above relay.
Figure 4:
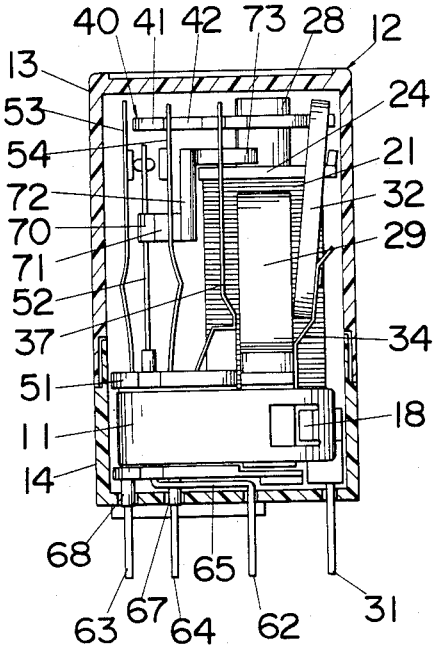
FIG. 4 is a front view, partly in cross section, of the above relay.
Figure 5:
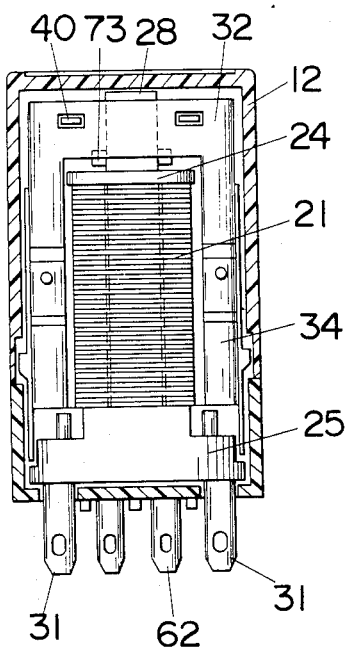
FIG. 5 is a right side view, partly in cross section, of the above relay.
Figure 6:
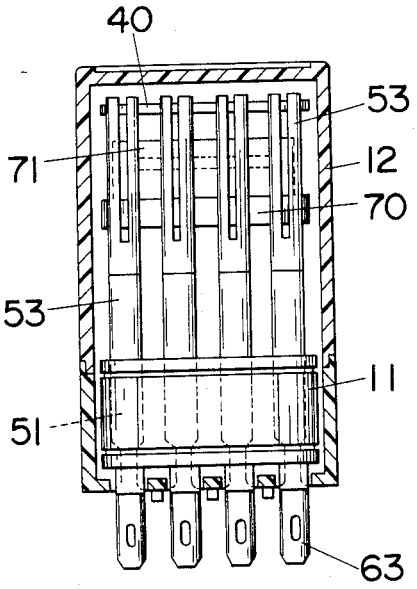
FIG. 6 is a left side view, partly in cross section, of the above relay.
Figure 7:
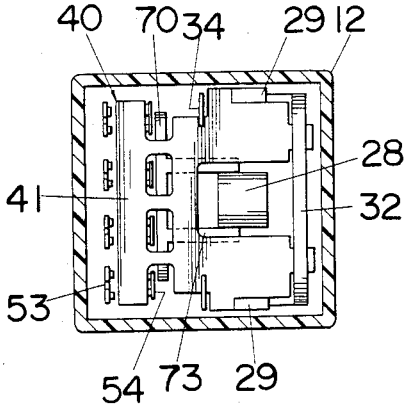
FIG. 7 is a top view, partly in cross section, of the above relay.

Each of the fixed or common contact members 52 is in the form of a rigid arm which is provided on both faces of its upper end portion with raised contacts. Each of the first and second contact members 53 and 54 is in the form of a spring arm biased toward the adjacent common contact member 52 so that the like contacts on one face of the bifurcated upper ends of each spring arm is in abutting engagement with the above contact on the adjacent common contact member 52 in the absence of external force. Formed at the front end portion of said card 40 is an actuator bar section 41 which is spaced from the rest of card 40 by a series of transversely aligned openings 42 and connected integrally thereto by stems separating those openings 42. The upper ends of said common contact members 52 terminate below those of the first and second contact members 53 and 54 to leave thereat a space for receiving the actuator bar section 41. That is, the actuator bar section 41 is interposed between the rows of the first and second contact members 53 and 54 with the upper end portions of the second contact members 54 extending upwardly through the corresponding openings 42 in such a way that the front and rear edges of the actuator bar section 41 are in engagement respectively with the first and second contact members 53 and 54, whereby the card 40 drives the first and second contact members 53 and 54 with respect to the common contact members 52 to simultaneously connect the set of the common contact members 52 to either of two sets of the first and second contact members 53 and 54. In the present embodiment, the card 40 is biased toward the electromagnetic unit 20 by means of a return spring 37 so that, as best shown in FIG. 4, the rear edge of the actuator bar section 41 pushes back the second contact members 54 against the biasing force thereof out of engagement from the common contact members 52 while allowing the first contact members 53 to be in contact engagement with the common contacts 52 when the card 40 is in the reset position. Upon energization of the excitation coil 21, the card 40 is moved against the biasing forces of the return spring 37 and the first contact members 53 into the set position, whereby it pushes forward the first contact members 53 out of contact engagement from the common contact members 52 while allowing the second contact members 54 to return to be in contact engagement with the common contact members 52. Consequently, the contact unit 50 defines a 4-pole double-throw switch in which the first and second contact members 53 and 54 serves respectively as normally-closed (NC) and normally-open (NO) contacts.

Also mounted on the contact base 51 are respective sets of common, first, and second terminal lugs 62, 63, and 64 which project downwardly therefrom as being connected respectively to the common, first, and second contact members 52, 53, and 54 on the upper side of the contact base 51. More exactly, the common, first, and second terminal lugs are mounted respectively on the base 56 of the common contact members 62, on the base 57 of the first or NC contact members 53, and on the base 55 of the second or NO contact members 54. The common, first and second terminal lugs are arranged in respective rows of which planes are disposed in parallel relationship with each other. The row of the first or NC terminal lugs 63 is in vertical alignment with that of the first or NC contact members 53 so as to be in substantially the same plane thereof. Similarly, the row of the second or NO terminal lugs 64 is in vertical alignment with that of the first or NO contact members 54 so as to be in substantially the same plane thereof. Each of the common terminal lugs 62 is integrally formed at its upper end with a horizontally extending transition segment 65 by which it is connected to the corresponding common contact member 52, each common terminal lug 62 being integrally formed with the corresponding fixed contact member 52 through said transition segment 65. With this transition segment 65 adapted to run along the under side of the contact base 51 from the portion just below the corresponding common contact member 52 toward the electromagnetic unit 20 beyond the adjacent second or NO terminal lug 64, the row of the common terminal lug 62 is displaced horizontally from that of the common contact members 52 so as to be located on the opposite side of the row of the second or NO terminal lugs 64 from that of the first or terminal lugs 63, thus presenting a terminal arrangement in which, as best shown in FIGS. 4, 8 and 9, the rows of the first (NC) terminal lugs 63, second (NO) terminal lugs 64, and common (COM) terminal lugs 62 are disposed in this order to have a NC-NO-COM terminal relation which is the same as that of the conventional general purpose relay of flexure type and therefore renders the relay of the present invention to be well compatible therewith. Each of the transition segments 65 is configured to be bent in a horizontal plane, as shown in FIG. 9, so that it extends around the adjacent second or NO terminal lug 64 in an insulated manner therefrom. For ensuring the insulation between the common terminal lug 62 and the adjacent second or NO terminal lug 64, each of the NO terminal lugs 64 has it root portion surrounded by an insulation sleeve 67 by which it is successfully spaced in an insulated manner from the adjacent transition segment 65. Said insulation sleeves 67 are integrally molded with the base 57 to project downwardly therefrom. The like sleeves 68 are also formed on the under side of the base 56 to surround the root portions of the first or NC terminal lugs 63.

The upper portions of said common contact members 52 extend through a header 70 of insulative material to be supported thereby in spaced relation with each other. Integral with the header 70 is a nose plate 71 which is spaced generally horizontally from the header 70 but connected thereto by means of laterally spaced extensions 72. This nose plate 71 is set in abutting engagement with said upper flanges 24 of the excitation coil 21 for accurately positioning the upper portion of the contact unit 50 in relation to that of the electromagnetic unit 20 at the time of assembling together these two units. In addition to the above, the end face of the contact base 51 is in abutting engagement with the confronting faces of the side legs 28 of the yoke 22 at the lower portion thereof to thereby provide accurate positioning between the lower portions of the contact unit 50 and the electromagnetic unit 20, thus ensuring exact alignment between the above two units 20 and 50. In fact, such abutting faces can be easily finished to be substantially flat surfaces for ensuring the exact alignment at the time of molding and stamping the corresponding parts.

A pair of prongs 73 project from the nose plate 71 so as to snugly receive therebetween the upper end of the core or the center leg 28 of the yoke 22 for further improving the accurate positioning, particularly for preventing possible lateral misalignment between the above two units. It is noted at this time that said second or NO contact members 64 extend vertically through apertures 74 formed between the adjacent extensions 72 and through notches 75 formed outside of the opposite extensions 72.

Said clamp 11 for securing together the electromagnetic unit 20 and the contact unit 50 is made of a metal sheet to be in a generally U-shaped configuration with a pair of resilient legs 16 connected by a web 17, each leg 16 having at its free end portion an inward hook 18 struck therefrom. The contact unit 50 and the electromagnetic unit 20 can be easily assembled together through the use of this clamp 11 which can be snapped over the contact base 51 and the coil base 25 in such a way as to engage said hooks 18 with the edges of the exposed side legs of said yoke 28 at the lower end portions thereof as a result of the inherent resiliency of the metal sheet from which the clamp 11 is made. These units 20 and 50 after being assembled together are accommodated within said relay casing 12 with various terminal lugs extending downwardly through complementary eyelets formed in the bottom wall of the casing 12.

Figure 11:
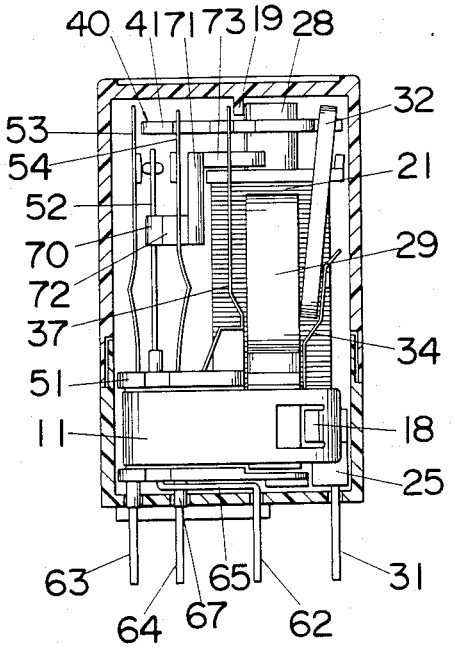
FIG. 11 is a front view, partly in cross section, of a modification of the first embodiment.
Figure 12:
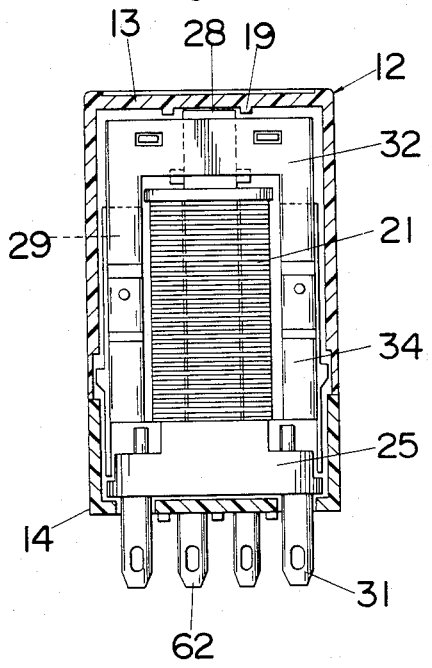
FIG. 12 is a right side view, partly in cross section, of the modification of FIG. 11.
Figure 13:
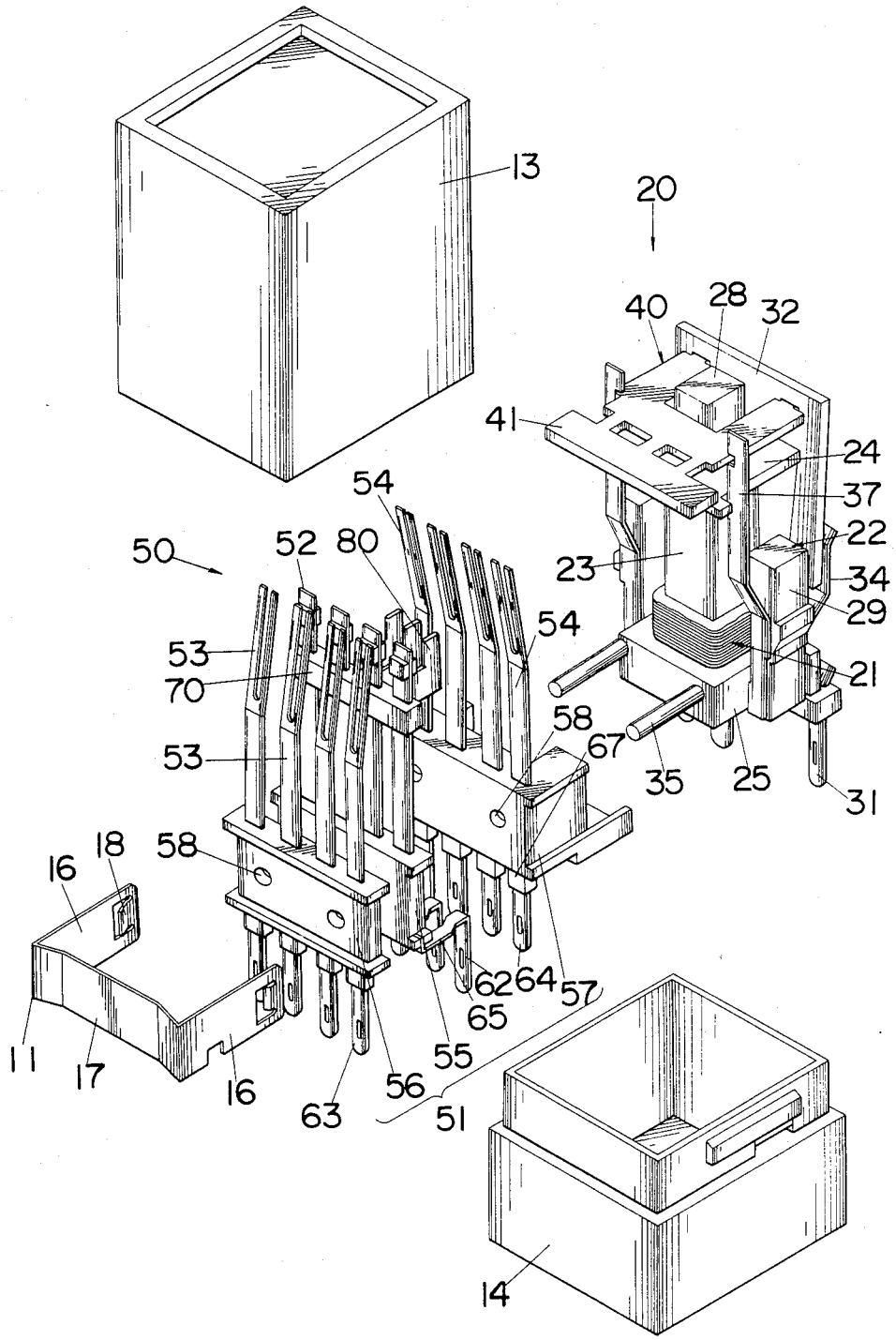
FIG. 13 is an exploded perspective view of a card relay in accordance with a second preferred embodiment of the present invention.
Figure 14:
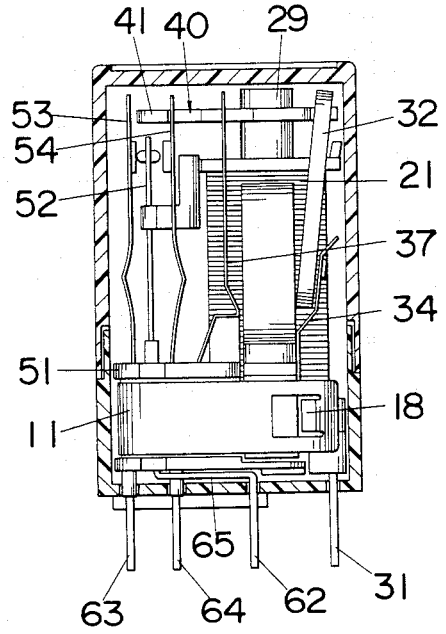
FIG. 14 is a front view, partly in cross section, of the relay of FIG. 11.
Figure 15:
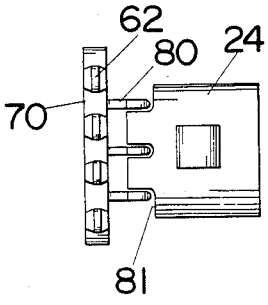
FIG. 15 is a plane view illustrating the relation between a header on a contact unit and an upper flange on an electromagnetic unit of the above relay.

FIGS. 11 and 12 show a modification of the above embodiment which is similar to the above first embodiment except that a support rib 19 is formed integrally on the undersurface of top wall of the casing 12. The support rib 19 is shaped in a generally U-shaped configuration as view in a horizontal plane for receiving therein the upper end of the center leg 28 of the yoke to thereby fixedly support the same within the casing 12. In this modification and a subsequently discussed second preferred embodiment, the same numerals are used to designate like parts as in the above first embodiment.

Figure 16:
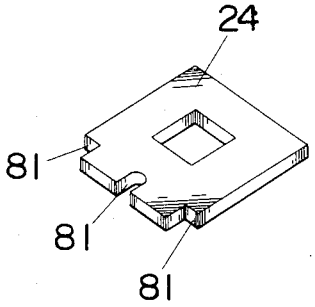
FIG. 16 is a perspective view of the upper flange of FIG. 15.

Referring now to FIGS. 13 through 16, there is illustrated the second preferred embodiment of the present invention which is similar to the above first embodiment except for the construction about the engaging relation between the upper portions of the electromagnetic unit 20 and the contact unit 50. In the present embodiment, the header 70 supporting the fixed contact members 52 is integrally formed with laterally spaced teeth 80 of generally L-shaped configuration each of which extends through the spacing between the adjacent ones of the second contact members 54 toward the electromagnetic unit 20. Formed in the edge portion of the upper flange 24 of the excitation coil 21 are spaced recesses 81, one in the form of a slot and the others in the form of notches on opposite sides of the slot, as shown in FIG. 16. These recesses 81 receive respectively the confronting end of said teeth 80 to prevent lateral misalignment between the contact unit 50 and the electromagnetic unit 20, thus improving accurate positioning therebetween. Besides the above, the three separate bases 55, 56, and 57 together forming said contact base 51 are respectively formed therein with aligned holes through all of which the projections 35 extend for the purpose of easily aligning these bases in the assembling direction.

What is claimed is:

1. An electromagnetic relay comprising:

(a) a contact unit having a base upon which are mounted a plurality of first movable contacts, a plurality of second movable contacts, and a plurality of fixed common contacts, each fixed common contact being disposed between a first and a second movable contact (b) an electromagnetic unit having an electromagnetic unit base upon which is mounted an excitation coil, (c) means for moving said first and second movable contacts alternately into and out of contact with said fixed common contacts in response to the energizing and deenergizing of said excitation coil, (d) first, second and common terminal lugs projecting from the base of said contact unit, said lugs being connected to said first and second moveable contacts and said fixed common contacts respectively, said first and second terminal lugs being linear extensions of said contacts through said base, and said common lugs being displaced toward the electromagnetic unit side of said first and second lugs, said common lugs being connected to said common contacts by insulated transition segments extending horizontally therebetween, (e) a header formed from an electrically nonconductive material encasing an upper portion of said fixed common contacts and having an extension portion for abutting an upper flange portion of said excitation coil, whereby said contact portion of said common contacts is held in a fixed position relative to said electromagnetic unit.

2. An electromagnetic relay as set forth in claim 1, wherein said extension portion is provided with a pair of prongs which snugly receive therebetween an upper end portion of a core of the excitation coil projecting above said upper flange.

3. An electromagnetic relay comprising:

(a) a contact unit having a base upon which are mounted a plurality of first movable contacts, a plurality of second movable contacts, and a plurality of fixed common contacts, each fixed common contact being disposed between a first and a second movable contact, (b) an electromagnetic unit having an electromagnetic unit base upon which is mounted an excitation coil, (c) means for moving said first and second movable contacts alternately into and out of contact with said fixed common contacts in response to the energizing and deenergizing of said excitation coil, (d) first, second and common terminal lugs projecting from the base of said contact unit, said lugs being connected to said first and second moveable contacts and said fixed common contacts respectively, said first and second terminal lugs being linear extensions of said contacts through said base, and said common lugs being displaced toward the electromagnetic unit side of said first and second lugs, said common lugs being connected to said common contacts by insulated transition segments extending horizontally therebetween, (e) a header formed from an electrically nonconductive material encasing an upper portion of said fixed common contacts and having a plurality of extensions which project between the adjacent movable contacts toward said excitation coil to engage recesses formed in an upper flange portion of said excitation coil.

4. The electromagnetic relay as set forth in claim 1, wherein each of said terminal lugs on the coil side of said common contacts has that portion within said base surrounded by an insulation sleeve by which it is insulatedly spaced from the adjacent transition segment leading to the corresponding common terminal lug.

5. The electromagnetic relay as set forth in claim 3, wherein each of said terminal lugs on the coil side of said common contacts has that portion within said base surrounded by an insulation sleeve by which it is insulatedly spaced from the adjacent transition segment leading to the corresponding common terminal lug.

6. The electromagnetic relay as set forth in claim 1, wherein said electromagnetic unit base is provided with at least one projection which projects toward the contact base of the contact unit so as to extend into a complementary hole formed in the contact unit base for interconnection therebetween, the contact unit and the electromagnetic unit being clamped together by means of a clip fastened around the electromagnetic unit and contact unit bases.

7. The electromagnetic relay as set forth in claim 3, wherein said electromagnetic unit base is provided with at least one projection which projects toward the contact base of the contact unit so as to extend into a complementary hole formed in the contact unit base for interconnection therebetween, the contact unit and the electromagnetic unit being clamped together by means of a clip fastened around the electromagnetic unit and contact unit bases.

8. The electromagnetic relay as set forth in claim 1, wherein said contact base is composed of three separate bases respectively for mounting said fixed, first and second contact members, said separate bases having therein aligned holes into which the projection of the electromagnetic unit base extends.

9. The electromagnetic relay as set forth in claim 3, wherein said contact base is composed of three separate bases respectively for mounting said fixed, first and second contact members, said separate bases having therein aligned holes into which the projection of the electromagnetic unit base extends.

* * * * *